United States Patent [19]

Pribis et al.

[11] Patent Number: 4,715,260

[45] Date of Patent: Dec. 29, 1987

[54] SEAL

[75] Inventors: Paul B. Pribis, Saratoga, N.Y.; Herbert J. West, Pittsfield, Mass.

[73] Assignee: General Electric Company, Pittsfield, Mass.

[21] Appl. No.: 945,152

[22] Filed: Dec. 22, 1986

[51] Int. Cl.[4] ..... F41F 1/04

[52] U.S. Cl. ..... 89/7; 92/159; 277/135

[58] Field of Search ..... 89/7, 26; 92/80, 154, 92/159, 160; 277/3, 27, 135

[56] References Cited

U.S. PATENT DOCUMENTS

| | | | |
|---|---|---|---|
| 539,733 | 5/1895 | Gerdom | 89/26 |
| 1,376,130 | 4/1921 | Ashbury | 89/26 |
| 2,066,489 | 1/1937 | Shannon | 92/80 |
| 2,073,886 | 3/1937 | Stifter | 92/80 |
| 2,092,599 | 9/1937 | Brill | 92/159 |
| 2,117,885 | 5/1938 | Hasek | 89/26 |
| 2,386,117 | 10/1945 | Hvid | 277/3 |
| 2,409,057 | 10/1946 | Meinke | 92/159 |
| 2,860,614 | 11/1958 | Burnand | 92/159 |
| 3,006,254 | 10/1961 | Thierry | 89/26 |
| 3,113,491 | 12/1963 | Borowka | 92/158 |
| 3,155,439 | 11/1964 | Guzewicz . | |
| 3,677,141 | 7/1972 | Lagerqvist | 92/85 R |
| 3,783,737 | 1/1974 | Ashley | 89/7 |
| 3,905,281 | 9/1975 | Clerk | 92/158 |
| 3,982,471 | 9/1976 | Finger | 92/158 |
| 3,996,837 | 12/1976 | Ashley | 89/26 |
| 4,050,352 | 9/1977 | Tassie | 89/7 |
| 4,067,401 | 1/1978 | Schnell | 92/160 |
| 4,218,961 | 8/1980 | Maasberg | 92/160 |
| 4,253,714 | 3/1981 | Bhushan | 29/148.4 L |
| 4,301,213 | 11/1981 | Davies | 428/419 |
| 4,316,921 | 2/1982 | Taylor | 60/39.08 |
| 4,466,165 | 8/1984 | Otto | 29/149.5 PM |
| 4,474,106 | 10/1984 | Durenec | 92/159 |
| 4,553,417 | 11/1985 | Badger | 29/148.4 L |
| 4,557,351 | 12/1985 | Volk | 92/160 |
| 4,586,422 | 5/1986 | Magoon | 89/7 |

FOREIGN PATENT DOCUMENTS 1096697 1/1961 Fed. Rep. of Germany .

OTHER PUBLICATIONS

"Metco Flame Spraying Processes", Bulletin 136C, Rev. 2/83, Copyright 1967, Metco, Inc., Westbury, L.I., N.Y.

*Primary Examiner*—Stephen C. Bentley
*Attorney, Agent, or Firm*—Bailin L. Kuch

[57] ABSTRACT

A decompression seal mechanism has a body containing a series of cavities formed by alternate grooves and lands and formed of a porous structure deposited by a plasma spray, and means for supplying said porous structure with a positive flow of liquid lubricant.

2 Claims, 3 Drawing Figures

SEAL

This invention was made with Government support under contract DAAK-11-84-C-0055 awarded by the U.S. Army. The Government has certain rights in this invention.

BACKGROUND OF THE INVENTION

1. Field of the Invention

This invention relates to lubricated seals for fluid high pressure systems such as liquid propellant guns.

2. Prior Art

Annular seals are well known, and are shown, for example, in Hasek, U.S. Pat. No. 2,117,885; Asbury, U.S. Pat. No. 1,376,130; Gerdom, U.S. Pat. No. 539,733; Thierry, U.S. Pat. No. 3,006,254; Wankel, Germany DAS No. 1,096,697; Ashley, U.S. Pat. No. 3,783,737; and Ashley, U.S. Pat. No. 3,996,837. Each of these seals functions by stressing a ring into abutment with a bore to provide a closed surface continuum, and is more or less effective for a limited number of firings. Tassie, in U.S. Pat. No. 4,050,352, issued Sept. 27, 1977, shows a liquid investment seal for the firing chamber of a liquid propellant gun; this seal is renewed at the commencement of each firing.

Lubricated surfaces are also well known, and are shown, for example, in Meinke, U.S. Pat. No. 2,409,057; Borowka, U.S. Pat. No. 3,113,491; Guzewicz, U.S. Pat. No. 3,155,439; Lagergrist, U.S. Pat. No. 3,677,141; Clerk, U.S. Pat. No. 3,905,281; Finger, U.S. Pat. No. 3,982,471; Schnell, U.S. Pat. No. 4,067,401; Maasberg, U.S. Pat. No. 4,218,961; Bhushan, U.S. Pat. No. 4,253,714; Davies, U.S. Pat. No. 4,301,213; Taylor et al, U.S. Pat. No. 4,316,921; Otto, U.S. Pat. No. 4,466,165; Durenec, U.S. Pat. No. 4,474,106; Badger, U.S. Pat. No. 4,553,417; and Volk, U.S. Pat. No. 4,557,351.

SUMMARY OF THE INVENTION

This invention relates to a lubricated seal for use at high pressures, e.g. 100,000 p.s.i. The combination of an upstream decompression seal and a downstream piston ring seal is previously known. The decompression seal, by turbulence generated in its cavities, serves to reduce the high pressure to a lower pressure such that the ring seal can provide positive sealing. However, the cavities of the decompression seal must be purged to prevent the accumulation therein of propellant, which might otherwise combust and cause failure of the decompression seal.

It is, therefore, an object of this invention to provide a decompression seal mechanism whose cavities are positively purged during each firing cycle.

It is another object to provide such a seal mechanism with a positive flow of lubrication.

It is yet another object to utilize the seal mechanism to damp the rearward movement of the piston which incorporates the seal mechanism.

It is even another object to provide a method of manufacture of such a seal mechanism.

A feature of this invention is the provision of a decompression seal mechanism having a body containing a series of cavities formed by alternate grooves and lands and formed of a porous structure, and means for supplying said porous structure with a positive flow of liquid lubricant.

BRIEF DESCRIPTION OF THE DRAWING

These and other objects, features and advantages of the invention will be apparent from the following specification thereof taken in conjunction with the accompanying drawing in which.

DESCRIPTION OF THE INVENTION

Figure 1:
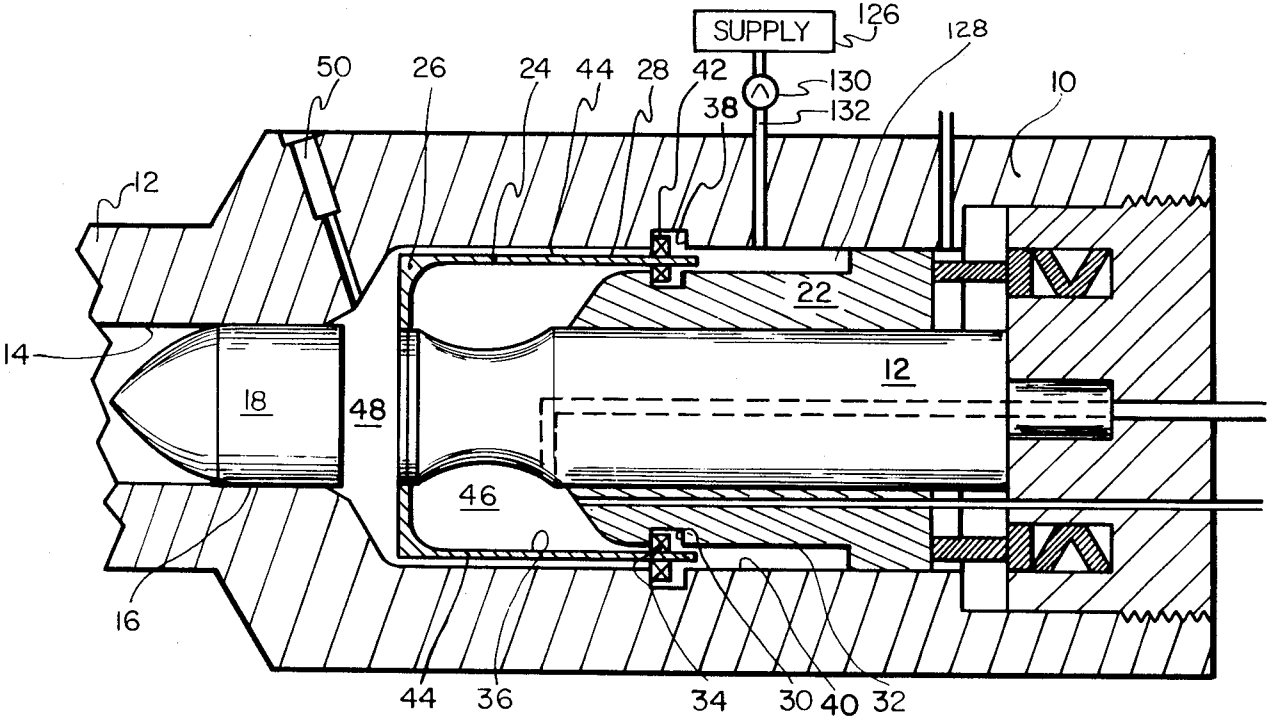
FIG. 1 is a detail of an exemplary liquid propellant gun of the type shown by R. E. Mayer in U.S. Pat. No. 4,341,147, issued July 27, 1982; I. K. Magoon in U.S. Pat. No. 4,523,507, issued June 18, 1985; R. E. Mayer et al in U.S. Pat. No. 4,523,508, issued June 18, 1985; and the application of I. K. Magoon, in U.S. Pat. No. 4,586,422; all particularly showing a conventional O-ring type seal mechanism under high pressure.

FIG. 1 is a detail of U.S. Pat. No. 4,523,507 issued Nov. 2, 1983 to I. K. Magoon, the disclosure of which is hereby incorporated by reference, and to which reference should be made for details not herein shown. The liquid propellant gun includes a housing 10 including a gun barrel 12 with a bore 14 and a chamber 16 into which a projectile 18 may be inserted. A stationary bolt 20 supports a fill piston or valve 22 which in turn supports a regenerative piston 24. The piston has a head 26 and a skirt 28. A groove 30 in the external surface 32 of the fill piston 22 carries an O-ring seal 34 against the internal surface 36 of the skirt 28. A groove 38 in the internal surface 40 of the housing carries an O-ring seal 42 against the external surface 44 of the skirt. Liquid propellant is pumped into the pumping chamber 46 defined between the respective heads of the two pistons 22 and 24. A combustion chamber 48 is defined between the base of the projectile 18 and the front face of the piston head 26. An ignitor 50 generates an initial pressure in the combustion chamber 48 adequate to provide an initial aftward displacement of the regenerative piston 24 with respect to the stationary bolt 20 so as to create an annular opening or gap between the bolt and the piston through which liquid propellant is injected from the pumping chamber 46 into the combustion chamber 48.

Figure 2:
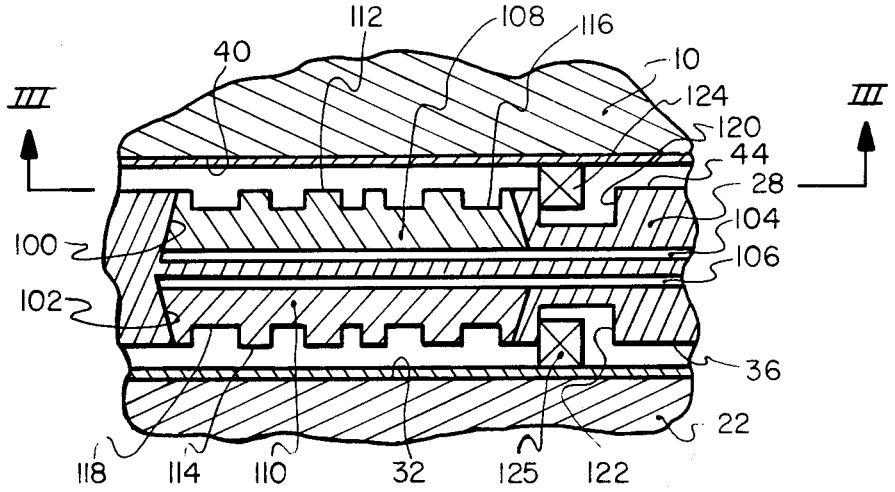
FIG. 2 is a detail of a gun similar to FIG. 1 but showing a seal mechanism between the skirt of the annular outer differential piston and the inner fill piston, and a seal mechanism between the skirt and the housing, both mechanisms embodying this invention.
Figure 3:
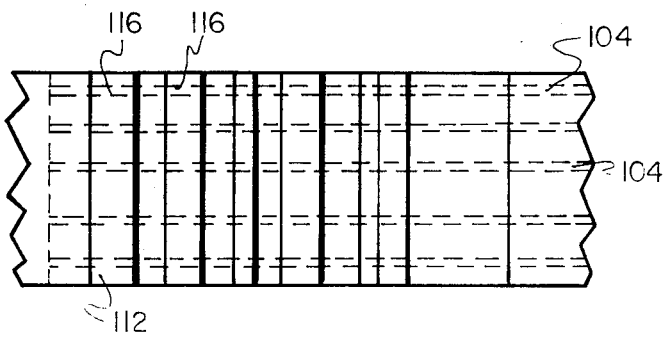
FIG. 3 is a cross-section of FIG. 2 taken along plane III—III.

The seal mechanisms of this invention are shown in FIGS. 2 and 3. While both an inner and an outer mechanism, each embodying this invention, are shown, the outer mechanism alone may be utilized in conjunction with an inner conventional mechanism. The seal mechanisms are fabricated as follows:

1. An outer annular groove 100 having a dove-tail cross section, i.e. side walls at an acute angle to the base, and a similar inner annular groove 102, are cut respectively into the outer surface 44 and the inner surface 36 of the piston skirt 28.

2. A plurality of longitudinal passageways 104 are drilled from the distal end of the skirt into, and along the base of, the groove 100, and a similar plurality of passageways 106 are drilled to the groove 102.

3. The passageways 104 and 106, including the portions thereof which are coextensive with the grooves 100 and 102, are filled with a material which can be subsequently removed. For example, lead which can be melted out by heat or amalgamated out by mercury; or salt which can be dissolved out with acid. The particular process will depend on the specific application and the specific seal and piston materials used.

4. The bodies 108 and 110 of the decompression seals are built up into the grooves 100 and 102. These bodies are made of a porous material, such as a metal deposited by an electric arc or other plasma spray process.

5. The respective series of cavities 116 and 118 are ground through the exterior surfaces 112 and 114 into the bodies 108 and 110.

6. The passageways 104 and 106, including the portions thereof which are co-extensive with the grooves 100 and 102 are cleared of their filling material, as by acid or heat or mercury.

An annular groove 120 is machined into the exterior surface 44 of the skirt between the seal body 108 and the distal end of the skirt, and a similar groove 122 is machined to the interior surface 36. An outer O-ring seal 124 is disposed in the groove 120, and an inner O-ring seal 125 is disposed in the groove 122.

The interior surface 40 of the housing and the exterior surface 32 of the fill piston may be coated with a suitable material to prevent galling, for example, a plasma arc sprayed ceramic material which is subsequently impregnated with a solid lubricant such as graphite or $MoS_2$. These coatings will lubricate any contact between the piston and the O-ring.

A supply 126 of lubricant is coupled to a dash pot chamber 128, which is defined by the housing, the fill piston and the piston skirt, through a check valve 130 and a passageway 132. The lubricant is provided at a pressure which is greater than that in the cavities before the firing cycle and seeps through the passageways 104 and 106, the bodies 108 and 110, and into the cavities 116 and 118 and the general decompression seal area, as this area is not a pressure tight boundary. This flow provides additional lubrication of the seal and purges the cavities and the lands of residual propellant.

During firing, after ignition, the regenerative piston 24 is forced aftwardly to reduce the volume of the pumping chamber 46 and to inject propellant into the combustion chamber 48. This aftward movement also serves to reduce the volume of the chamber 128, positively forcing lubricant through the passageways 104 and 106 and the bodies 108 and 110. Since the porous bodies 108 and 110 act as a resistance to flow, a damping action is provided to the aftward movement of the piston. The coefficient of damping is a direct function of the porosity and may be predetermined thereby.

If desired, the metal and ceramic coatings may be deposited utilizing the Metco Flame Spraying Processes described in Bulletin 136C, revision 2/83, copyright 1967, by Metco, Inc., Westbury, L.I., N.Y.

What is claimed is:

1. A sealing mechanism for a pump comprising:
a housing having a cavity with an inner wall;
a central journal disposed in said housing cavity;
a piston having a piston head and a skirt defining a central cavity, said skirt having its distal region disposed on said central journal with one end of said journal projecting into said piston central cavity to define a pumping chamber between said projecting one end of said journal and said piston head and a clearance gap between said skirt and said housing cavity inner wall; and
a sealing mechanism for sealing said clearance gap;
characterized in that
said sealing mechanism comprises:
an additional pumping chamber defined by said housing cavity inner wall, said journal and the distal end face of said skirt;
a porous annular body disposed into the annular exterior surface of said skirt adjacent said housing cavity inner wall;
a plurality of annular grooves disposed in said body, each groove opening towards said housing cavity inner wall;
a passageway through said skirt coupling said porous body with said skirt distal end face; and
means for providing liquid into said additional pumping chamber; and
having a mode of operation wherein liquid flows from said additional pumping chamber through said passageway, through said porous body, through said annular grooves and into said clearance gap.

2. A liquid propellant gun comprising:
a housing having a cavity with an inner wall;
a central journal disposed in said housing cavity;
a regenerative piston having a piston head and an annular skirt defining a central cavity,
said skirt having its distal region disposed on said central journal with one end of said journal projecting into said piston central cavity to define a propellant pumping chamber between said projecting one end of said journal and said piston head, to define a combustion chamber between said piston head and said housing including a clearance gap between said skirt and said housing cavity inner wall;
a sealing mechanism for sealing said clearance gap;
characterized in that
said sealing mechanism comprises:
a lubricant pumping chamber defined by said housing cavity inner wall, and the distal end face of said skirt;
a porous annular body disposed into the annular exterior surface of said skirt adjacent said housing cavity inner wall;
a plurality of annular grooves disposed in said body, each groove opening towards said housing cavity inner wall;
a passageway through said skirt coupling said porous body with said skirt distal end face;
a seal member disposed in one of said annular grooves remote from said piston head and proximate to said skirt distal end and obturating said clearance gap;
means for providing lubricating liquid into said lubricant pumping chamber; and
having a mode of operation wherein liquid flows from said lubricant pumping chamber, through said passageway, through said porous body, through said annular grooves and into said clearance gap.

* * * * *